US006637470B2

(12) United States Patent
Reihl et al.

(10) Patent No.: US 6,637,470 B2
(45) Date of Patent: Oct. 28, 2003

(54) TRANSFERRING DEVICE

(75) Inventors: Bruno Reihl, Wilen B. Wollerau (CH); Michel Hirsiger, Bern (CH); Bruno Boos, Kirchberg (CH); Hanspeter Stoller, Bern (CH); Edgar Hommann, Grossaffoltern (CH); Paolo Pollak, Basel (CH); Peter Latscha, Muemliswil (CH); Sandra Soniec, Burdgorf (CH); Andreas Eberhart, Oberburg (CH)

(73) Assignee: Disetronic Licensing AG, Burgdorf (CH)

( * ) Notice: Subject to any disclaimer, the term of this patent is extended or adjusted under 35 U.S.C. 154(b) by 0 days.

(21) Appl. No.: 10/084,014

(22) Filed: Feb. 25, 2002

(65) Prior Publication Data

US 2002/0189705 A1 Dec. 19, 2002

Related U.S. Application Data

(63) Continuation of application No. PCT/CH00/00471, filed on Sep. 5, 2000.

(30) Foreign Application Priority Data

Sep. 9, 1999 (DE) ..... 299 15 878

(51) Int. Cl.[7] ..... B65B 1/04

(52) U.S. Cl. ..... 141/27; 141/59; 141/2; 141/18; 604/411; 604/416

(58) Field of Search ..... 604/411, 412, 604/413, 414, 415, 416; 141/2, 18, 21, 27, 67, 59

(56) References Cited

U.S. PATENT DOCUMENTS

| | | | | |
|---|---|---|---|---|
| 4,058,121 A | * 11/1977 | Choksi et al. | ..... | 604/411 |
| 4,585,439 A | 4/1986 | Michel | ..... | 604/155 |
| 4,874,368 A | 10/1989 | Miller et al. | ..... | 604/82 |
| 4,883,472 A | 11/1989 | Michel | ..... | 604/208 |
| 4,966,588 A | 10/1990 | Rayman et al. | ..... | 604/165 |
| 5,033,476 A | 7/1991 | Kasai | ..... | 128/764 |
| 5,137,181 A | 8/1992 | Keller | ..... | 222/134 |
| 5,209,739 A | 5/1993 | Talalay | ..... | 604/195 |
| 5,273,544 A | 12/1993 | van der Wal | ..... | 604/134 |
| 5,286,453 A | 2/1994 | Pope | ..... | 422/100 |
| 5,334,162 A | 8/1994 | Harris | ..... | 604/232 |
| 5,337,756 A | 8/1994 | Barbier et al. | ..... | 128/763 |
| 5,370,629 A | 12/1994 | Michel et al. | ..... | 604/207 |
| 5,407,434 A | 4/1995 | Gross | ..... | 604/167 |
| 5,435,076 A | 7/1995 | Hjertman et al. | ..... | 34/296 |
| 5,460,618 A | 10/1995 | Harreld | ..... | 604/264 |
| 5,472,422 A | 12/1995 | Ljungquist | ..... | 604/89 |
| 5,501,673 A | 3/1996 | Hjertman et al. | ..... | 604/191 |
| 5,545,143 A | 8/1996 | Fischell | ..... | 604/180 |

(List continued on next page.)

FOREIGN PATENT DOCUMENTS

| | | | | |
|---|---|---|---|---|
| CH | 676 548 A5 | 2/1991 | ..... | A61J/1/06 |
| DE | 3627231 A1 | 2/1988 | ..... | A61J/1/06 |
| EP | 0 126 718 A2 | 11/1984 | ..... | A61J/1/00 |
| EP | 0 298 067 B1 | 1/1989 | ..... | A61M/5/24 |
| EP | 0 518 416 A1 | 12/1992 | ..... | A61M/5/20 |
| WO | WO 91/10460 | 7/1991 | ..... | A61M/5/24 |
| WO | WO 98/47552 | 10/1998 | ..... | A61M/5/24 |

*Primary Examiner*—Steven O. Douglas
(74) *Attorney, Agent, or Firm*—Dorsey & Whitney LLP

(57) ABSTRACT

A device for transferring a fluid product from one container to another including a hollow needle suitable for piercing a membrane and having a first, front opening, the needle being connectable to one of the containers via a first, rear hollow needle opening so that the fluid product can be conveyed into or out of the container through the hollow needle and hollow needle openings, the needle having a second, rear opening which forms a fluid connection between the another container and a pressure compensation device or the environment while the fluid is being transferred.

21 Claims, 11 Drawing Sheets

U.S. PATENT DOCUMENTS 5,545,152 A 8/1996 Funderburk et al. ..... 604/283
5,549,561 A 8/1996 Hjertman ..... 604/131
5,716,338 A 2/1998 Hjertman et al. ..... 604/89
5,746,724 A * 5/1998 Powles et al. ..... 604/240
5,776,125 A 7/1998 Dubar et al. ..... 606/411
5,800,390 A 9/1998 Hayakawa et al. ..... 604/93
5,817,055 A 10/1998 Ljungquist ..... 604/89
5,827,244 A 10/1998 Boettger ..... 604/283
5,954,687 A 9/1999 Baudino ..... 604/48
5,975,367 A 11/1999 Coelho et al. ..... 222/137
6,070,623 A * 6/2000 Aneas ..... 141/329

* cited by examiner

A:

A:

A:

TRANSFERRING DEVICE

PRIORITY CLAIM

This application is a continuation of International Patent Application PCT/CH00/00471, filed on Sep. 5, 2000, which claims priority to an earlier filed German Application Number DE 299 15 878.0, filed Sep. 9, 1999.

BACKGROUND OF THE INVENTION

1. Technical Field

The invention relates to the transfer of a fluid which itself is already an injectable product or which forms an injectable product when brought together with a solid or fluid component. The invention further relates to a multi-lumen cannula such as is suitable for transferring a fluid in a particular way.

2. Description of the Related Art

Devices for transferring medicines, mostly using so-called disposable syringes, have been known to patients and medically trained personnel for a long time. Essentially, in the case of a disposable syringe, the cannula is pushed through a puncture membrane of a normal medicine container, then air is pressed through the cannula into the medicine container in order to finally suction medicine from the medicine container through the cannula into the disposable syringe. Normal medicine containers are containers air-tight sealed which have an opening sealed by a puncture membrane.

The same transferring process is also the basis for filling a disposable ampoule which is inserted into an infusion pump or an injection pen. Such infusion pumps are known for example from patent specification EP 0 143 895. Injection pens are known for example from patent specification WO 87/02895. Disposable ampoules differ from disposable syringes in that the cannula can be de-coupled from the rest of the ampoule casing and the stopper from the piston rod. The transferring process is elaborate.

A device for transferring a product fluid from one container into another container is known from CH 676 548 A5, wherein another solid or fluid product is situated in the other container. The other container is sealed at the front end by a puncture membrane and at the rear end by a movable stopper. When transferring the product fluid into the other container, the stopper is pushed further backwards. The product fluid thus comes into contact with an area of the other container which has been previously exposed to the environment. This results in problems of sterility.

More recent injection pens and infusion pumps are designed for the use of so-called pre-filled ampoules, i.e. ampoules which are filled by a medicine manufacturer and not by the patient. Such injection pens or infusion pumps are known from patent specifications WO 93/16740 and WO 98/47552. In order to prevent supply bottle-necks with such pre-filled ampoules, and for the same injection pen or the same infusion pump to be easily used with as many different medicines as possible, the supplier of injection pens and infusion pumps should also provide devices which enable a medicine to be transfused from a normal medicine container into a disposable syringe or disposable ampoule, and then into an ampoule which is preferably filled with a sterile gaseous substance, or otherwise into an ampoule which is identical to the pre-filled ampoule. These ampoules which are preferably filled with a sterile gaseous substance or are otherwise identical to the pre-filled ampoule are called empty ampoules in the following. Empty ampoules consist of an ampoule body which is sealed at its front end by a puncture membrane and at its rear end by a movable stopper. The stopper is arranged at the rear end of the empty ampoule for reasons of sterility. If the medicine is then to be transfused from the disposable ampoule or disposable syringe into the empty ampoule, the sterile gaseous substance has to be displaced, since the stopper arranged at the rear end of the empty ampoule would otherwise be forced out of the empty ampoule.

SUMMARY OF THE INVENTION

It is an object of the invention to provide a transferring device for a product fluid which is easily operated by the patient and which enables the product fluid to be transferred into a container which is at least partially filled with gas, without changing the volume of the container.

The object is solved by the subjects of the independent claims.

A transferring device for transferring a product fluid comprises: a first container with a container opening through which the product fluid can be delivered into the first container or out of the first container; a delivering means for delivering the product fluid into the first container or out of the first container; and a cannula which is suitable for piercing a membrane and which comprises a front, first cannula opening. The cannula is or can be connected to the first container via a rear, first cannula opening, such that the product fluid can be delivered through the cannula and the cannula openings into the first container or out of the first container. In accordance with the invention, the cannula comprises a rear, second cannula opening which during transfer forms a fluid connection from a second container to a pressure equalization means or directly to the environment. In this way, a pressure burden or partial vacuum arising from the product fluid being delivered in or out of the second container is decreased without changing the volume of the second container. If the second container is sealed by a piston, no force is exerted on it once the pressure in the second container is equal to the ambient pressure. The piston is prevented from moving.

A fluid connection between the first container and the second container, and a fluid connection between the second container and the pressure equalization means or the environment, is created via the cannula. These fluid connections are established via at least one lumen in the cannula which is connected to the cannula openings. Particularly preferably, the cannula is fixedly connected to the first container. In order to establish a fluid connection, a membrane with which the second container is sealed is pierced through. If both containers are sealed with a membrane, one cannula can be used to establish the fluid connection between the two containers, by the cannula piercing both membranes.

Particularly preferably, the cannula comprises at least two lumens, wherein the fluid connection between the first and the second container is formed by one of the two lumens and the fluid connection between the second container and the pressure equalization means or the environment is formed by the other of the two lumens. One of the at least two through lumens extends from the front, first cannula opening to the rear, first cannula opening and the other of the at least two through lumens extends between a front, second cannula opening and the rear, second cannula opening. The at least two through lumens can be designed in one part, for example by channels or bores. Preferably, a double-lumen tube can be used, whose openings are accordingly connected to the containers. Each through lumen is preferably designed in its own part. Preferably, two conventional hollow injection needles are used, which jointly form the cannula.

The at least two through lumens are preferably arranged side by side. They are particularly preferably arranged parallel. If, for example, two conventional hollow injection needles are used, these can form the cannula spaced parallel. They are preferably fixedly connected to each other, particularly preferably along an outer surface line of the injection needles, respectively.

The puncture membrane of the second container is preferably pierced by the two hollow injection needles. Each injection needle comprises two ends. The front ends of the two injection needles are preferably cut at an angle, to facilitate piercing the membrane. The rear ends of the injection needles are connected to different spaces. The rear end of one injection needle is connected to the first container, for example to the hollow space of a disposable syringe or a disposable ampoule, and the rear end of the other injection needle terminates exposed in the environment. In principle, a connection to the environment can also be established by a differently designed opening on the other injection needle. If, for example, this injection needle is drawn up as far as the ampoule, then the connection to the environment or to another pressure equalization space can for example be formed in this injection needle by a lateral, i.e. radial opening. A fluid connection to the product fluid in the first container exists via one of the two injection needles and not via the other.

In accordance with the invention, the injection needles are collectively designated as the cannula. The two hollow injection needles are preferably arranged axially side by side. The injection needles are preferably connected to each other by a bridge. Particularly preferably, the outer surface areas are connected to each other by welding, soldering or adhesion.

Particularly preferably, one of the at least two through lumens surrounds the other of the at least two through lumens. It can for example be realized by arranging two hollow injection needles with different diameters one inside the other. To form the rear, second cannula opening, the outer injection needle is provided with an opening, for example a slot or a bore. In this way, a space-saving cannula results which can be simply pierced through the membrane by the user.

If two through lumens are provided in the cannula, then the product fluid flows for example out of the first container, via the first through lumen, into the second container, the excess gas, in particular air, simultaneously escaping from the second container through the second through lumen.

Preferably, the cannula only comprises a single through lumen extending from a front cannula opening to a rear, first cannula opening. A rear, second cannula opening is provided between the front cannula opening and the rear, first cannula opening. The rear, second cannula opening is preferably formed by a slot or a hole in the lateral surface area of the cannula. A hollow, one-lumen injection needle can be used as the cannula. Transport of the product fluid between the first container and the second container on the one hand, and pressure equalization between the second container and the pressure equalization means or the environment, take place through the part of the lumen between the front cannula opening and the rear, second cannula opening. The rear, second cannula opening is preferably permeable to gas but not to liquid. A first through lumen is formed by the lumen of the cannula between the front cannula opening and the rear, first cannula opening, and a second through lumen is formed by the lumen between the front cannula opening and the rear, second cannula opening. A section of the lumen of the cannula alternatively or simultaneously forms a part of the first and the second through lumen. A particularly simple cannula is provided which establishes a fluid connection both between the first and the second container and between the second container and a pressure equalization means or the environment.

A cannula is preferably formed by a conventional hollow injection needle whose outer surface area deviates from a circular shape such that, after the membrane is pierced, at least one hollow space remains between the outer surface area of the injection needle and the membrane, such that a fluid connection results between the second container and the environment. The at least one hollow space is preferably formed by at least one groove running along the surface area of the injection needle. The at least one groove is formed such that the membrane does not completely fill it. The fluid connection between the first and the second container is established via the through lumen of the injection needle.

A shortest distance between the front, first cannula opening and the rear, second cannula opening is preferably smaller than a shortest distance between the front, first cannula opening and the rear, first cannula opening. This arrangement of the cannula openings is advantageous if two containers are to be connected to each other and the second container is to be evacuated of air into the environment between the two containers.

The cannulae described above establish the fluid connection between the first and the second container, as well as the fluid connection between the second container and the pressure equalization means or the environment, simultaneously. The cannulae establish the fluid connections by piercing through the membrane of the second container. These fluid connections can be established by a simple linear movement between the first and the second container.

If product fluid is suctioned out of the second container, for example a normal medicine container sealed by a membrane, into the first container, for example a disposable syringe or ampoule, the puncture membrane of the medicine container is pierced by the cannula and the hollow space of the disposable syringe or ampoule is then enlarged, such that product fluid is suctioned through the cannula into the hollow space of the disposable syringe or ampoule. A syringe is preferably provided with a piston which may be moved manually via a piston rod in the syringe. No partial vacuum arises in the normal medicine container, as ambient air simultaneously or near simultaneously enters the normal medicine container through the cannula.

If medicine is to be dispensed from the disposable syringe or ampoule into an empty ampoule, the puncture membrane of the empty ampoule is pierced by the cannula, and the hollow space of the disposable syringe or ampoule is then reduced. Injecting medicine through the cannula does not lead to a pressure burden in the empty ampoule, as the sterile, gaseous substance can escape through the cannula. The cannula preferably includes at least two through lumens, in particular a transport lumen and a ventilation lumen.

In order to make it easier for the patient to pierce through the puncture membrane, the containers involved in the transferring process are preferably clamped in a transferring device which ensures an axial arrangement of the containers and stabilizes the containers with respect to each other.

The transferring device comprises a container holder, which preferably consists of two parts of which each part holds one of the two containers. Both containers comprise a container opening, the two containers being inserted into the transferring device such that the two container openings face each other. The transferring device enables the containers to linearly move towards each other, by way of at least one of the two containers being shiftably supported. A cannula as described above is situated between the two containers, such that when the containers are moved towards each other, a fluid connection is formed between the first and the second container as well as a fluid connection between the second container and the pressure equalization means or the environment.

Both container openings can be sealed by a membrane, wherein the cannula is then pierced through both membranes. The cannula is preferably fixedly connected to one of the two containers and pierces through the membrane sealing the container opening of the other container.

The cannula preferably consists of a transport or connection cannula which connects the two container openings to each other, and a ventilation or compensation cannula which connects the second container to the pressure equalization means or to the environment. The connection cannula and the compensation cannula can be combined in one cannula. They can, however, also be used separately. Particularly preferably, the connection cannula is fixedly connected to the first container and pierces the membrane of the second container sealing the container opening of the second container, when the two containers are moved towards each other. The compensation cannula is situated between the two containers and likewise pierces the membrane of the second container when the containers are shifted towards each other. The compensation cannula is preferably accommodated in a cannula holder which is situated between the two containers. The cannula holder is likewise shiftably held in the device.

The second container is preferably sealed at the front end by a membrane, and at the rear end by a piston. In order to rule out the possibility that, for example, the piston is also not shifted backwards when the ventilation lumen of the cannula is sealed, a protruding part can preferably be provided on the part of the container holder which holds the second container, said protruding part protruding into the second container far enough that said protruding part just abuts the outer end of the piston and thus determines the maximum rear position of the piston in the second container.

The device can be used for a whole succession of transferring and mixing medicines, in various containers.

Particularly preferably, the device is used for transferring a fluid from one container to another container, wherein the fluid itself is a product fluid or forms a product fluid once it is filled together with a solid or fluid component.

Such a transferring device is particularly preferably used as a device for separately storing a first, fluid component and a second, fluid or solid component of the product fluid, and for forming the injectable product fluid by bringing together these components.

BRIEF DESCRIPTION OF THE DRAWINGS

Preferred example embodiments of the invention will now be described by way of figures. These show.

DETAILED DESCRIPTION

Figure 1A:
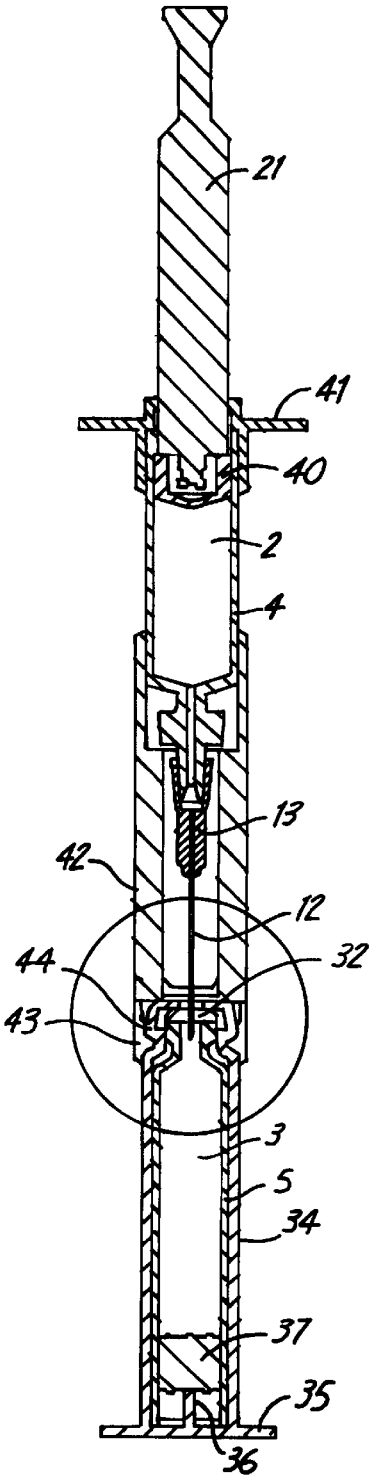
FIG. 1*a* a transferring device in a longitudinal section.

FIG. 1*a* shows a transferring device for transferring a product fluid from a first container 2 into a second container 3. The first container 2 is formed by a syringe 4, the second container 3 by an ampoule 5. The syringe 4 comprises a cylindrical body in which a piston 40 is movably mounted and defines a space of the container 2 to the rear. The piston 40 can be moved via a delivering means 21 formed by a piston rod 21. The space of the container 2 is provided with an outlet opening at the front, to which a cannula 12 can be connected. The cannula 12 is preferably held in a cannula holder 13 which forms a connecting piece between the syringe 4 and the cannula 12. The cannula holder 13 is preferably connected to the syringe 4 via a Luer cone.

The second container 3 is formed by an ampoule 5 consisting of a cylindrical basic body. A piston 37 or a stopper 37 is moveably arranged at the rear, open end of the cylindrical basic body. A front, open end of the cylindrical hollow body is sealed by a membrane 32, in particular a self-sealing septum 32. A space is formed in the second container 3 between the septum 32 and the piston 37. Preferably, there is sterile gas in this space before a product fluid is transferred into it. The second container 3 can also be formed by a supply ampoule which contains the product fluid. A specified amount of the product fluid can be taken from the supply ampoule by means of the syringe 4. The product fluid can then be directly injected, or dispensed from the syringe 4 into an ampoule 5. The ampoule 5 can then for example be used in known infusion pumps.

The transferring device comprises a first holding sleeve 42 for the first container 2 and a second holding sleeve 34 for the second container 3.

In order to establish a fluid connection between the containers 2, 3, these are inserted into their respective holding sleeves 34, 42, and the holding sleeves are moved towards each other lineally, such that the front openings of the containers 2, 3 move towards each other frontally. The cannula 12 which is fixedly connected to the syringe 4 via the connecting piece 13 thus pierces the membrane 32 of the second container 3. When the two holding sleeves 34, 42 move towards each other, click cams 43 are pushed over a protrusion 44 of the second holding sleeve 34. Preferably, a number of click cams 43 are distributed evenly over the perimeter of the first holding sleeve 42. There arises a fixed connection between the two holding sleeves 34, 42. Through the formation of the click cams 43 with the protrusion 44, the depth of penetration of the cannula 12 into the membrane 32 and the second container 3 is preferably determined. It is also possible to place the first holding sleeve 42 directly onto an ampoule. The ampoule then preferably has the same shape in the front area, in particular the same protrusion, as the second holding sleeve 34.

Figure 1B:
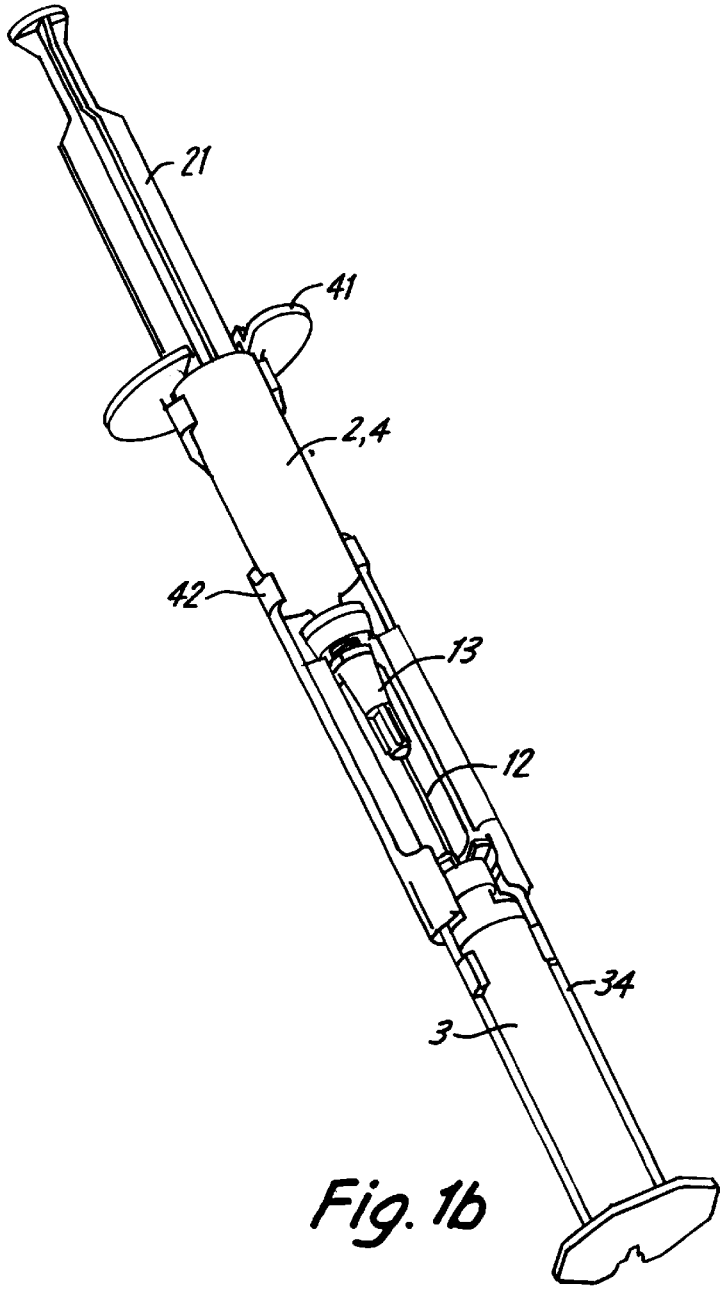
FIG. 1*b* a transferring device in a three-dimensional representation.

FIG. 1*b* shows the transferring device in a three-dimensional representation. The syringe 4 is inserted into the first holding sleeve 42 and the ampoule 5 into the second holding sleeve 34. The two holding sleeves 34, 42 are pushed into each other, such that a fluid connection is established between the containers 2, 3 via the cannula 12.

In the following, the transferring device shall be explained on the basis of FIG. 1*b*. It is assumed that product fluid, in particular medicine, is situated in the syringe 4. Through pressure on the piston rod 21, the stopper (not shown) arranged in the syringe 4 and connected to the piston rod 21 is pushed towards the outlet opening of the syringe 4 and therefore towards the cannula 12, thereby pressing medicine out of the hollow space of the syringe 4, through the cannula 12, into the ampoule 5. The gaseous sterile substance situated in the ampoule 5 is forced through the cannula 12 into the environment. The transferring device ensures an axial arrangement of the containers 2, 3 and an ideal depth of penetration of the cannula 12 into the puncture membrane 32.

It can also be shown on the basis of FIG. 1*b* that the device also serves to empty a normal medicine container. Instead of the movable stopper 37, a normal medicine container or a supply ampoule comprises a solid wall. The medicine container is placed directly onto the device. By moving the piston rod 21 counter to the direction of delivery described above, the hollow room in the first container 2 is enlarged, and medicine is correspondingly suctioned through the cannula 12 into the syringe 4. The cannula 12 in accordance with the invention ensures that no partial vacuum arises in the medicine container.

In the following, individual components of the transferring device are described in more detail.

Figure 1C:
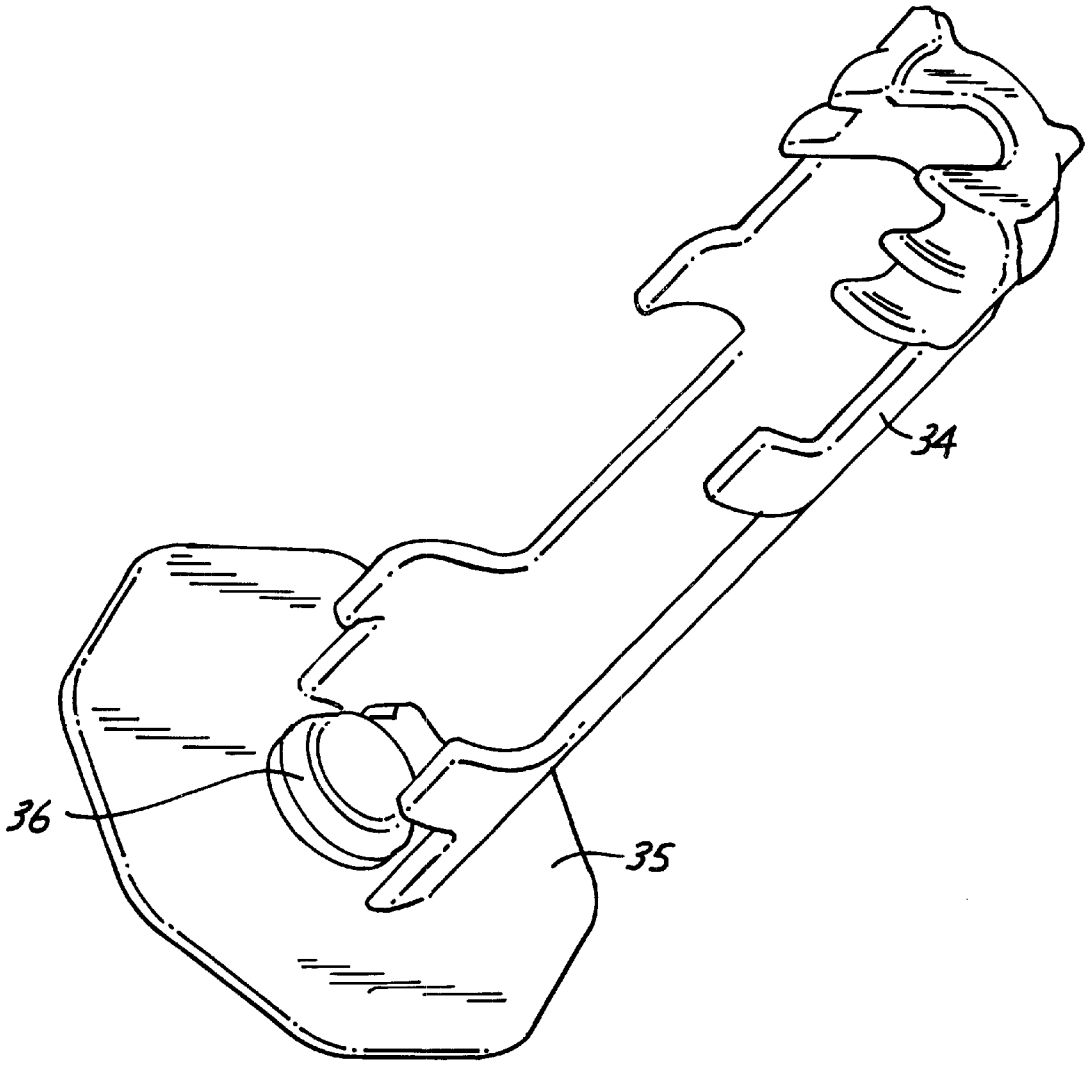
FIG. 1*c* a holding sleeve for a second container.
Figure 1D:
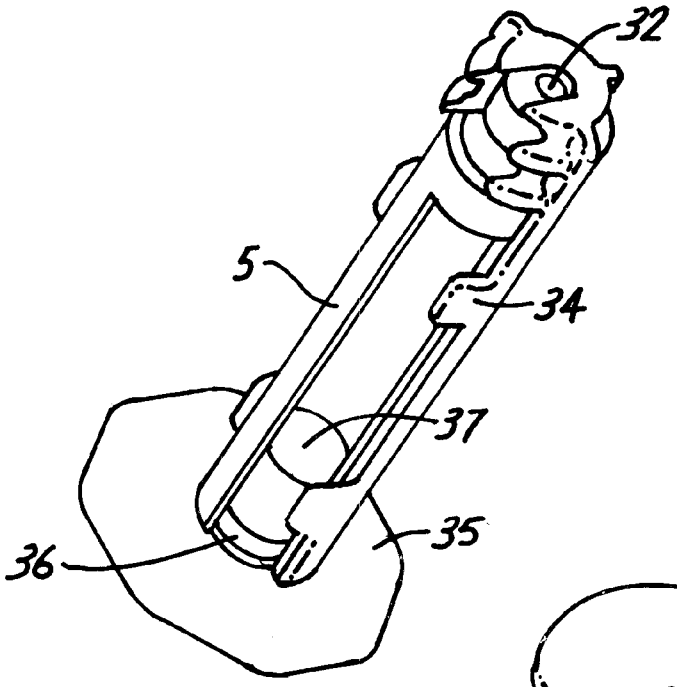
FIG. 1*d* the holding sleeve from FIG. 1*c*, comprising a second inserted container.

FIG. 1*c* shows the holding sleeve 34 for the ampoule 5 (FIG. 1*d*). The holding sleeve 34 comprises a round base plate 35 and a cylindrical tube projecting perpendicular thereto, wherein a part of the casing of the cylindrical tube is missing, so that the ampoule 5 can be inserted laterally into the tube. A slightly protruding part 36 protrudes from the base plate 35 into the cylindrical tube.

It can be seen from FIG. 1*d* that the protruding part 36 extends from the base plate 35 to the piston 37 of the ampoule 5. This additionally ensures that the piston 37 cannot move backwards out of the ampoule 5 towards the base plate 35.

Figure 1E:
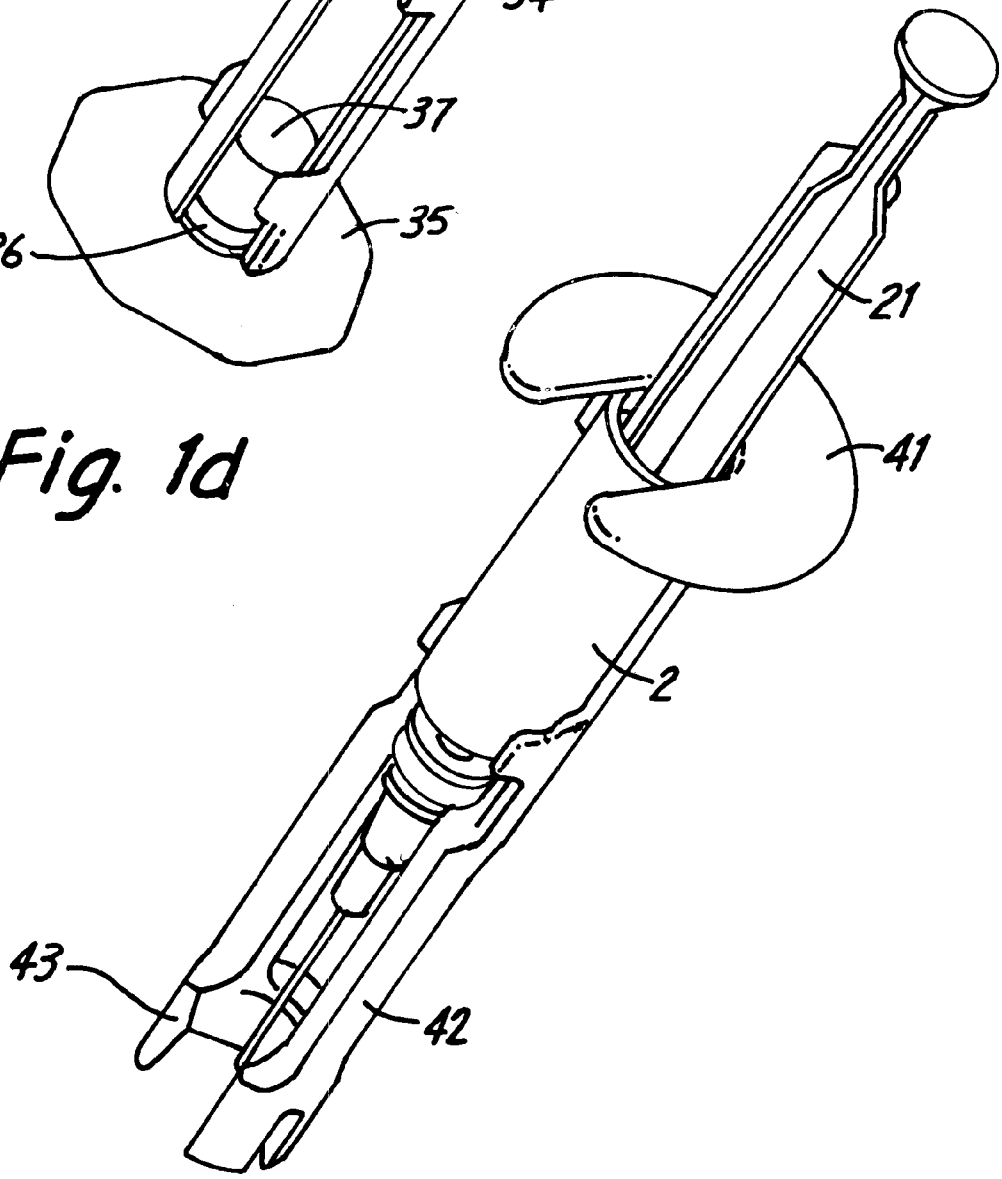
FIG. 1*e* a holding bush for a first container.

FIG. 1*e* shows the first holding sleeve 42 for the syringe 4, with an inserted syringe 4. The first holding sleeve 42 comprises a U-shaped end plate 41 and a tube projecting perpendicular thereto, wherein a part of the casing of the cylindrical tube is missing, such that the syringe 4, a disposable ampoule or a disposable syringe can be inserted laterally. The U-shaped end plate 41 allows the piston rod 21 to project through at the same time as the syringe 4 is axially fixed in place. A connecting device 43, in particular click cams 43, is arranged at the end of the cylindrical tube opposite the end plate 41, for fixing a medicine container or the second holding sleeve 34 in place using appropriately worked counter elements 44. The length of the cylindrical tube and the arrangement of the click cams 43 allow the cannula 12 to be securely placed with respect to the medicine container or the ampoule 5.

FIGS. 2 to 7 show different embodiments of the cannula 12. FIGS. 3 to 7 correspond here to Detail A in FIG. 1*a*.

Figure 2:
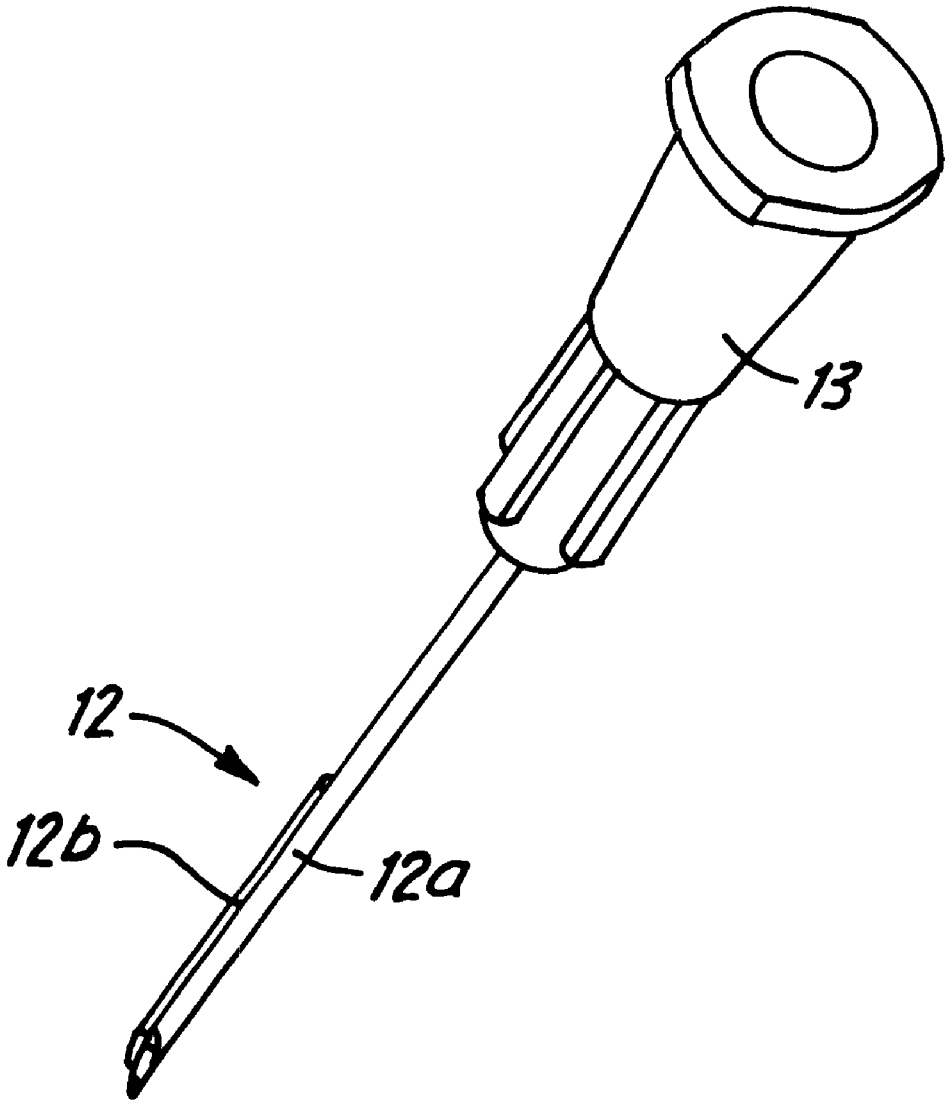
FIG. 2 a cannula in accordance with the invention, comprising a double lumen, in a three-dimensional view.

FIG. 2 shows a cannula 12 for the syringe 4 (FIG. 1*e*), consisting of two hollow injection needles 12*a*, 12*b* arranged side by side, wherein the injection needle 12*a* is connected to the syringe 4 via the connecting piece 13. The injection needle 12*a* is a connection cannula 12*a* for transporting product fluid. The other injection needle 12*b* is arranged parallel alongside the connection cannula 12*a*, and serves as a ventilation or compensation cannula 12*b*. The two cannulae 12*a*, 12*b* are cut at an angle at their front ends in order to pierce through the puncture membrane 32 (FIG. 1*a*).

The front ends of the two hollow injection needles 12*a*, 12*b* are situated at about the same height in order to ensure that both have pierced the puncture membrane 32 when used. The two injection needles 12*a*, 12*b* are of different lengths. At its rear end, the transport cannula 12*a* opens into the connecting piece 13, while the rear end of the ventilation cannula 12*b* is open, such that air and other gaseous substances can flow through. The inner diameter of the ventilation cannula 12*b* is preferably smaller than that of the transport cannula 12*a*.

The transport cannula 12*a* can also end directly in the first container 2. The connection or transport cannula 12*a* forms a first through lumen between the first container 2 and the second container 3. The ventilation cannula 12*b* forms a second through lumen between the second container 3 and the environment. It can also be connected to a pressure equalization means.

Figure 3:
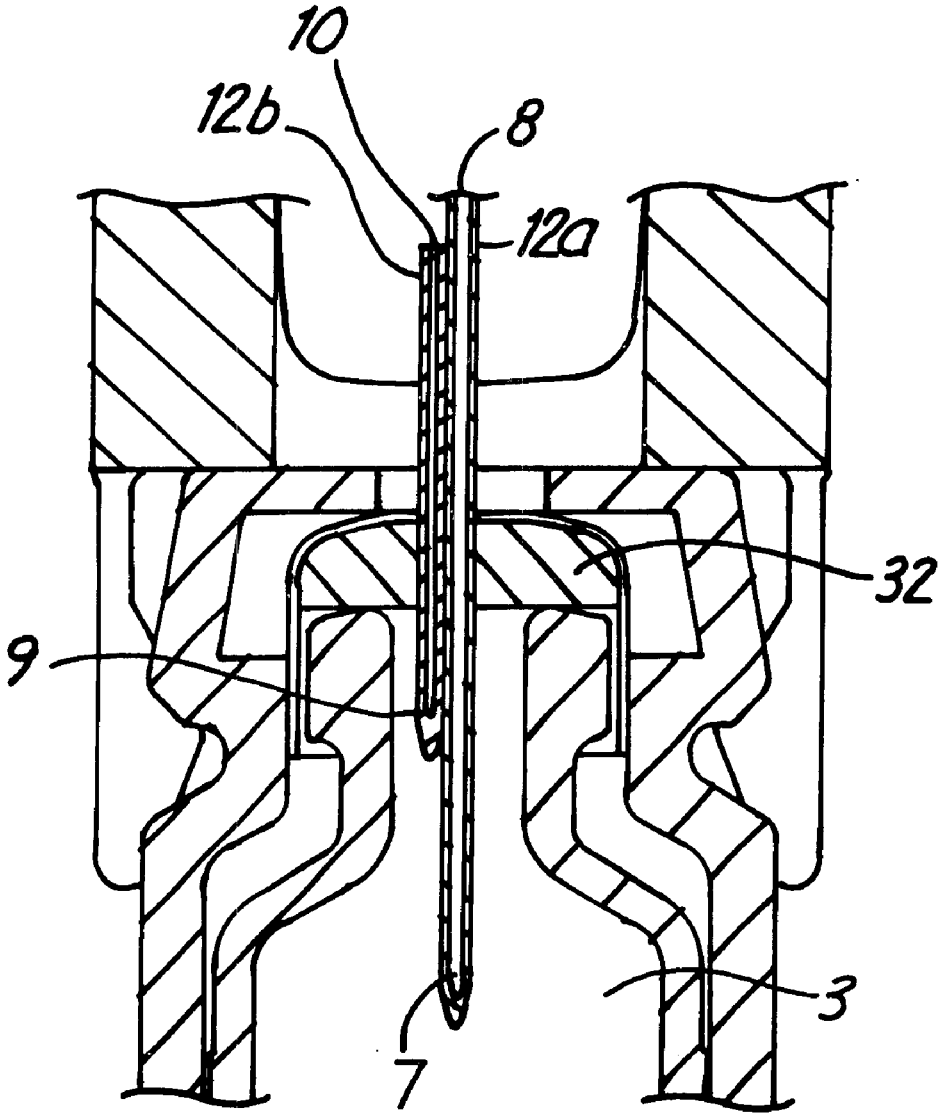
FIG. 3 a cannula in accordance with the invention in a longitudinal section.

FIG. 3 shows the double-lumen cannula 12 described above, in a longitudinal section. The first through lumen of the connection cannula 12*a* extends from a front, first cannula opening 7 to a rear, first cannula opening 8. The rear, first cannula opening 8 is connected or can be connected to the first container 2 via the connecting piece 13. The connection of the connection cannula 12*a* to the first container 2 is not shown in the drawing. The second through lumen is formed between a front, second cannula opening 9 and a rear, second cannula opening 10 of the compensation cannula 12*b*. The ends of the connection cannula 12*a* and the compensation cannula 12*b* are cut at an angle at the front cannula openings 9, 7, such that tips are formed, so that the cannula 12 can easily pierce through the membrane 32.

The front cannula openings 7, 9 are arranged in different positions axially. The front, first cannula opening 7 is preferably arranged in front of the front, second cannula opening 9 in the direction of piercing through the membrane 32. The force required for the cannula 12 to pierce through the membrane 32 is thus reduced.

Figure 4:
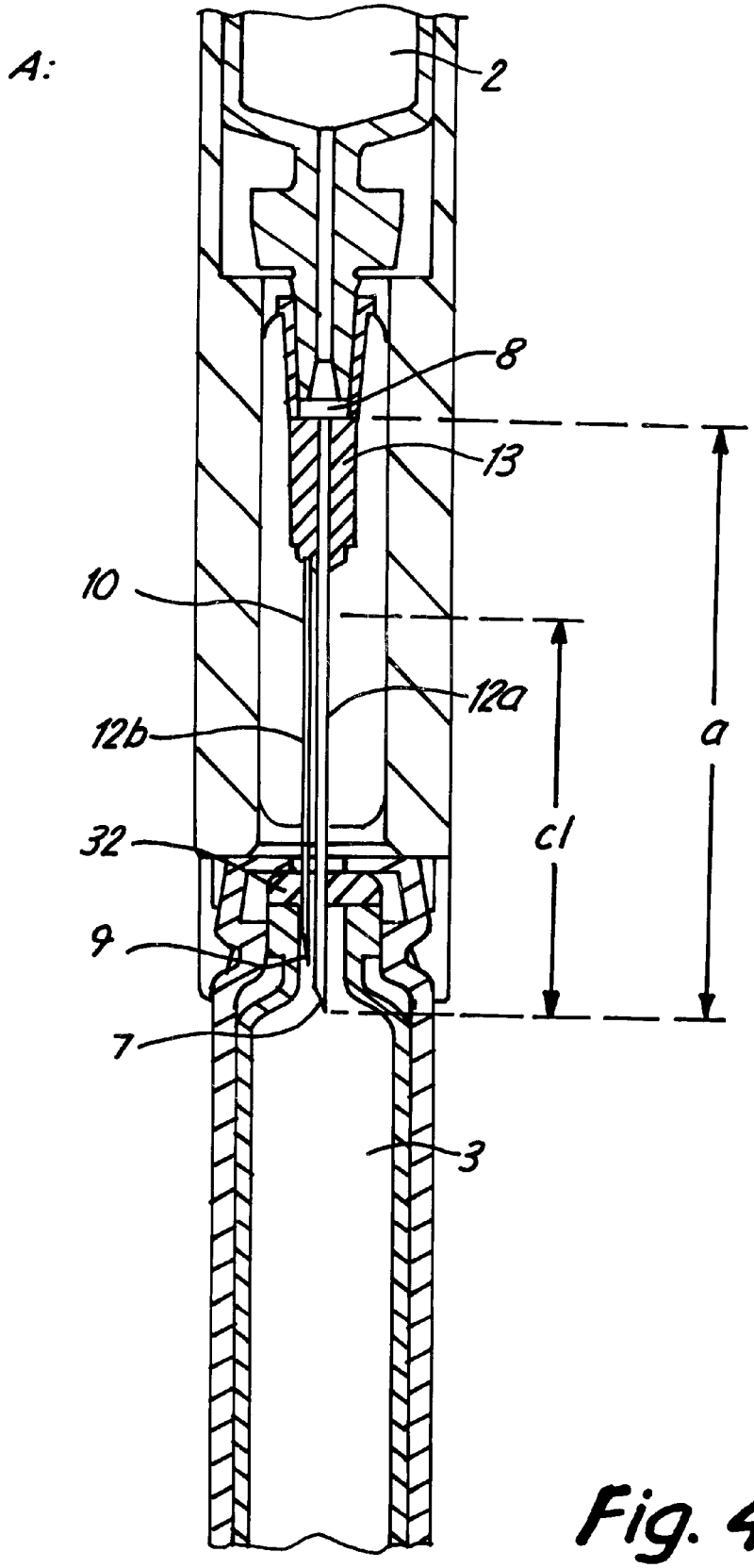
FIG. 4 a cannula in accordance with the invention, comprising two hollow injection needles.

FIG. 4 shows a cannula 12 comprising a conventional hollow injection needle 12*a* which is accommodated in the connecting piece 13. Another hollow injection needle 12*b* is arranged alongside the hollow injection needle 12*a*, spaced parallel. This is likewise fixedly connected to the connecting piece 13, but does not comprise a fluid connection to the first container 2. The rear, second cannula opening 10 is formed by a lateral slot or lateral bore, in particular a cross bore, in the other hollow injection needle 12*b*. The injection needles 12*a* and 12*b* pierce the septum 32 side by side.

On the basis of FIG. 4, it will now be explained how the cannula openings 7, 8, 9 and 10 are arranged with respect to one another. A shortest distance from the front, first cannula opening 7 to the rear, first cannula opening 8 is designated a; a shortest distance between the front, first cannula opening 7 and the rear, second cannula opening 10 is designated d.

The distance d is preferably smaller than the distance a. The rear, second cannula opening 10 forms a fluid connection to the environment situated between the two containers 2, 3.

Figure 5:
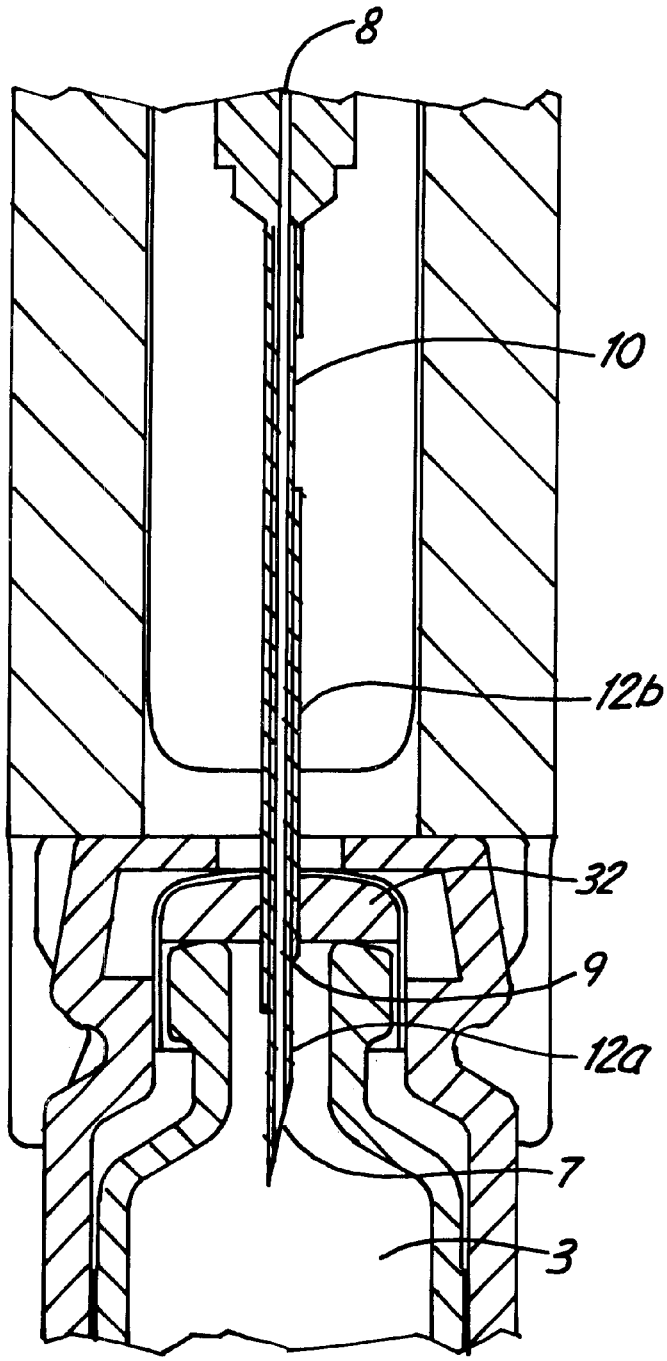
FIG. 5 a cannula in accordance with the invention, comprising concentric lumens.

The through lumens of FIG. 5 are formed by concentric, hollow injection needles 12*a*, 12*b*. The first through lumen is formed by the connection cannula 12*a* between the cannula openings 7 and 8. The second through lumen is formed between the outer surface area of the connection cannula 12*a* and the inner surface area of the ventilation cannula 12*b*. The rear, second cannula opening 10 arises from a lateral opening in the surface area of the ventilation cannula 12*b*. The distance between the rear, second cannula opening 10 and the front, second cannula opening 9 is preferably less that the distance between the rear, second cannula opening 10 and the front, first cannula opening 7.

Figure 6:
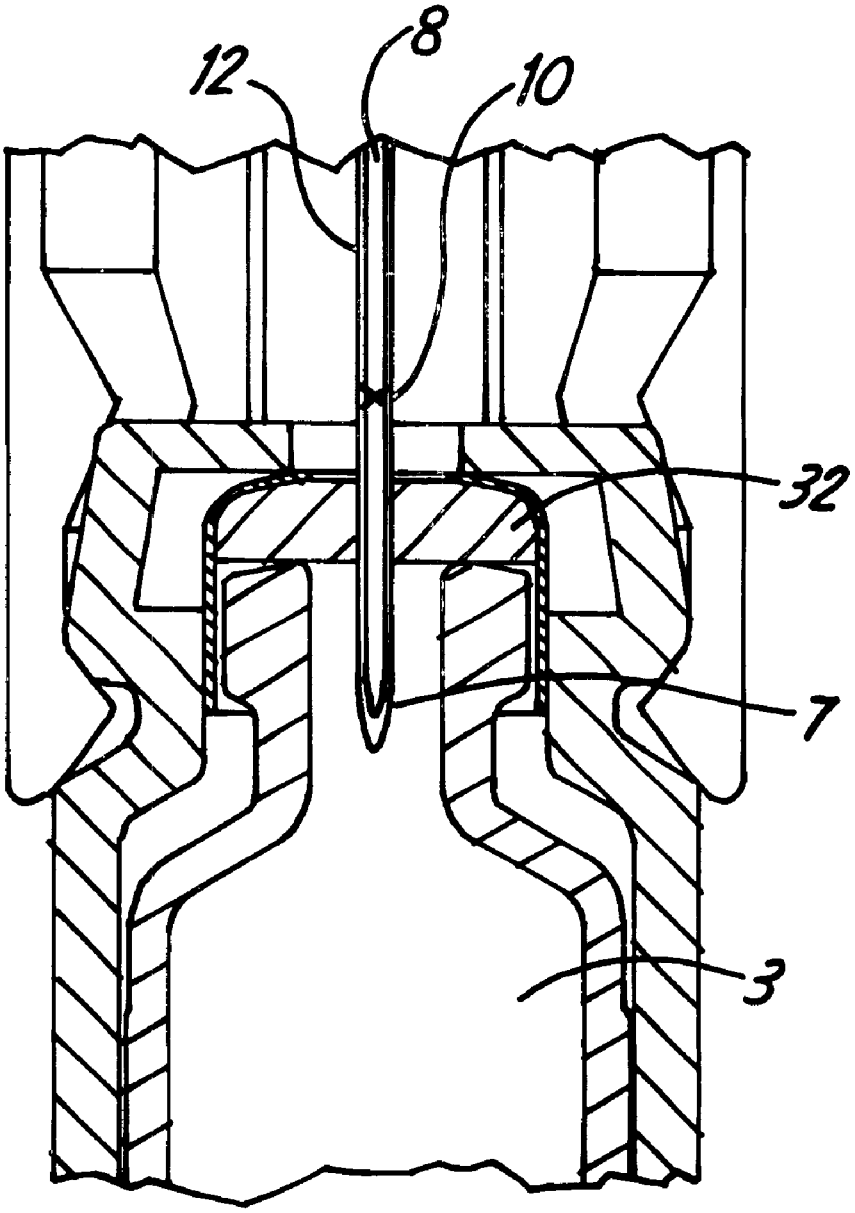
FIG. 6 a cannula in accordance with the invention, comprising a single lumen and a cross bore.

FIG. 6 shows a one-lumen cannula 12. It is formed by a conventional hollow injection needle 12, wherein the rear, second cannula opening 10 is a lateral opening in the cannula 12, in particular a cross bore through the cannula 12. This cross bore is preferably designed to be liquid-tight, such that only gases can get through. Its diameter is preferably small enough that no liquid can get through. However, it can also be provided with a liquid-tight membrane. Particularly preferably, an elongated area of the cannula 12 is designed to be liquid-tight and permeable to gas. A front cannula opening 7 simultaneously serves to transfer product fluid as well as to ventilate/evacuate the second container 3. If, for example, product fluid is suctioned from the second container 3 via the cannula 12, then ambient air simultaneously flows through the rear, second cannula opening 10, the cannula 12 and the front cannula opening 7, into the second container 3, to equalize the pressure. Particularly preferably, the desired amount of product fluid is here suctioned step-by-step from the second container 3 into the first container 2, a short pause being inserted after each individual step, a particularly fast pressure equalization between the environment and the second container 3 taking place in said pause. Such a cannula only pierces through the membrane 32 at one point, and for this reason a particularly low piercing force is required. A conventional hollow injection needle can be used, which only has to be provided with a cross bore. The cross bore is arranged at a point in the cannula 12 such that, in the pierced position, a connection to the environment is established, i.e. it is arranged outside the second container 3. Instead of the cross bore, a simple opening can also be provided in the side wall of the cannula 12, in particular an elongated slot.

If a cannula in accordance with FIG. 6 is used, two positions of the syringe 4 with the cannula 12 placed on it are preferably provided. The two positions differ from each other in the depth of penetration of the cannula 12 into the second container 3. In a first position of cannula 12, the rear, second cannula opening 10 is also situated within the second container 3. In a second position of the cannula 12, the rear, second cannula opening 10 is outside the second container 3 and establishes a connection to the environment, and the front cannula opening 7 is situated within the second container 3. FIG. 6 shows the second position. If fluid is to be suctioned out of the second container 3 into the first container 2, the cannula 12 is inserted into the second container 3 far enough that the cannula 12 assumes its first position. During the transferring process, there is no fluid connection between the second container 3 and a pressure equalization means or the environment. During the transferring process, a partial vacuum builds up in the second container 3. After the transferring process, the cannula 12 is drawn out of the second container 3 far enough for it to reach its second position. The rear, second cannula opening 10 thus establishes a connection to the environment, such that the second container 3 is ventilated and the partial vacuum is decreased. If fluid is to be dispensed from the first container 2 into the second container 3, then the cannula 12 is situated in its first position for transporting fluid and in its second position for ventilating the second container 3. The cannula 12 thus assumes a different position for transporting fluid than for ventilating. In order to make handling the device easier for the user, the holding sleeve 42 is preferably provided with two stoppers, such that the syringe 4 can be shifted within the holding sleeve 42 between its first and its second position. The holding sleeve 42 is particularly preferably designed to be shiftable within itself, in particular telescopically, such that the syringe 4 can be shifted between the two positions with the cannula 12 together with a part of the holding sleeve 42.

Figure 7:
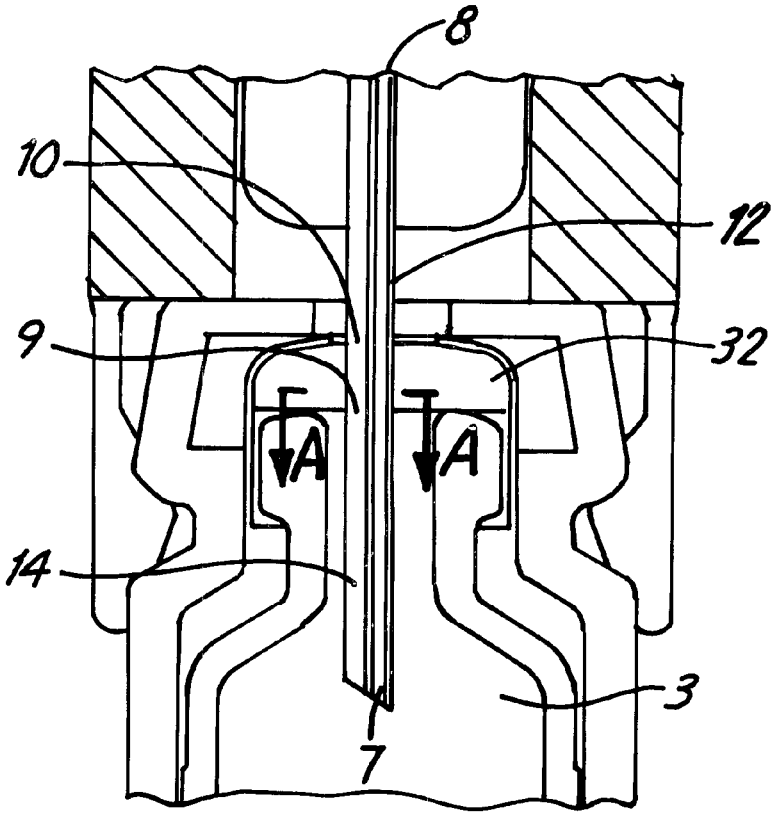
FIG. 7 a cannula in accordance with the invention, comprising a lateral groove.
Figure 7:
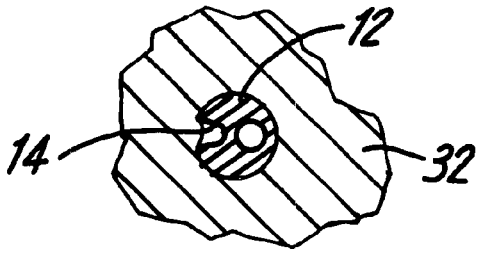

FIG. 7 shows a one-lumen cannula 12 comprising a lateral groove 14. As can be seen from the cross-section A, the axial projection of the outer surface area of the cannula 12 deviates from a circular shape, such that the groove 14 is formed, preferably along the entire length. If the cannula 12 is pierced through the septum 32, the septum 32 does not seal the groove 14 completely. The second through lumen is formed between the groove 14 and the septum 32, to ventilate the second container 3. The first through lumen extends from the front, first cannula opening 7 to the rear, first cannula opening 8. A simple cannula 12 is provided in which the product fluid is transported and the second container is ventilated via separate through lumens.

Figure 8:
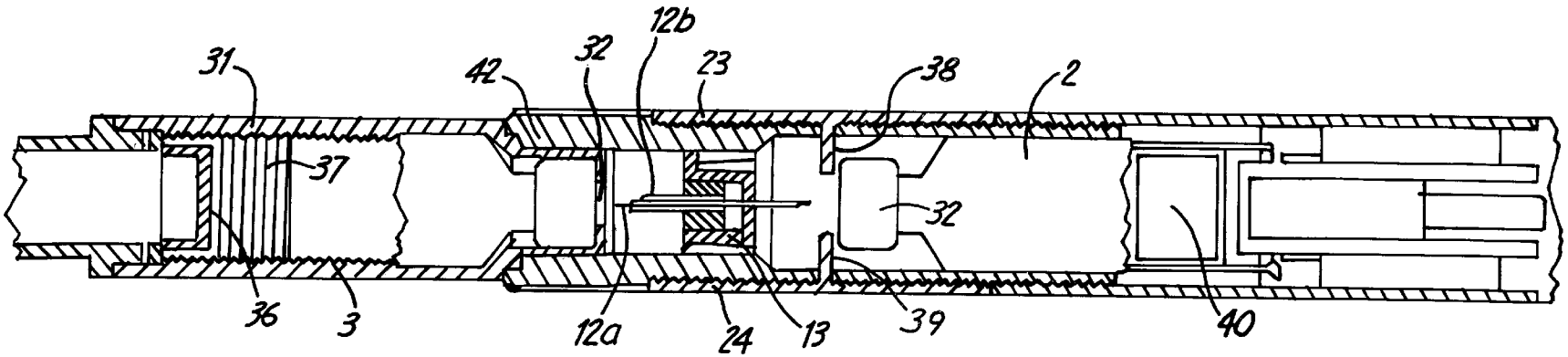
FIG. 8 a device for separately storing and bringing together two components of a product fluid.
Figure 9:
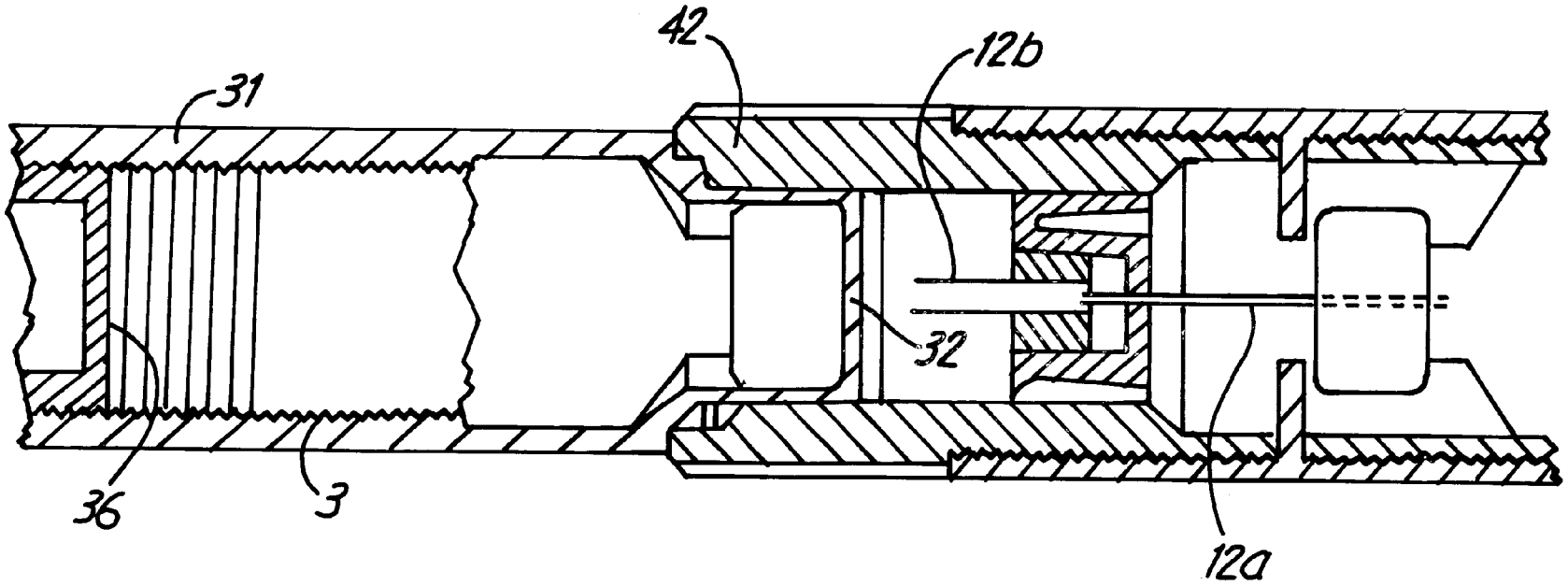
FIG. 9 an alternative cannula in accordance with the invention, for a device as set forth in FIG. 8.

FIGS. 8 and 9 show a device for separately storing and bringing together a first, fluid component and a second, solid or fluid component, in particular two components of a product fluid such as is known from CH 676 548 A5. To establish a fluid connection between the first container 2 and the second container 3, a cannula 12 in accordance with the invention and as described above is used.

FIG. 8 shows two containers 2, 3 whose front ends are each sealed by a septum 32 and whose rear ends are each sealed by a piston 37, 40. Product fluid is to be filled from the first container 2 into the second container 3. The piston 37 of the second container 3 remains in its original position, preferably at the rear end of the second container 3. The containers 2, 3 are shown in their starting positions in a transferring device. A cannula 12 mounted movably in the transferring device is situated between the two front ends of the two containers 2, 3. It is preferably mounted in a cannula holder 13 mounted shiftably in the transferring device. The fluid connection between the two containers 2, 3 is prevented from being involuntarily established by safety organs 23, 24 comprising safety stays 38, 39. To establish a fluid connection, the lateral safety organs 23, 24 are radially removed outwards. The first container 2 can then be moved towards the second container, wherein the cannula 12 is slaved. When shifted, the cannula 12 pierces the membranes 32 of the containers 2, 3. A fluid connection between the first container 2 and the second container 3 is formed by the connection cannula 12*a*. The compensation cannula 12*b* forms a fluid connection between the second container 2 and the environment. In the example embodiment, the cannulae 12*a*, 12*b* are arranged concentrically with respect to each other. If the piston 40 is moved towards the front container opening of the first container 2, product fluid flows from the first container 2 into the second container 3. Since the volume of the second container 3 is not changed, excess gas or air flows from the second container 3, via the compensation cannula 12*b*, into the environment.

FIG. 9 shows a further embodiment of the cannula in accordance with the invention. Here, the connection cannula 12*a* is fixedly connected to the first container 2, and the compensation cannula 12*b* is movably mounted between the first container 2 and the second container 3. If the first container 2 is moved towards the second container 3, then on the one hand the connection cannula 12*a* pierces the septum 32 of the second container 3 and on the other hand the first container 2 slaves the compensation cannula 12*b*, such that the compensation cannula 12*b* also pierces the septum 32 of the second container 3. The connection cannula 12*a* is preferably here moved by the compensation cannula 12*b*. It could, however, also be guided along, alongside the compensation cannula 12*b*. A syringe 4 with a conventional cannula 12*a* can thus also be used as the first container 2.

In the foregoing description preferred embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

List of Reference Numerals

| | |
|---|---|
| 2 | first container |
| 3 | second container |
| 4 | syringe |
| 5 | ampoule |
| 7 | front, first cannula opening |
| 8 | rear, first cannula opening |
| 9 | front, second cannula opening |
| 10 | rear, second cannula opening |
| 12 | cannula |
| 12a | connection cannula |
| 12b | ventilation cannula |
| 13 | connecting piece |
| 14 | lateral groove |
| 21 | delivering means |
| 23 | safety organ |
| 24 | safety organ |
| 31 | ampoule |
| 32 | membrane, septum |
| 34 | holding sleeve |
| 35 | base plate |
| 36 | protruding part |
| 37 | stopper |
| 38 | safety stay |
| 39 | safety stay |
| 40 | piston |
| 41 | end plate |
| 42 | holding sleeve |
| 43 | connection means, click cams |
| 44 | protrusion |

What is claimed is:

1. A transferring device for transferring a product fluid from a first container having an opening to a second container having an opening sealed by a membrane, said transferring device comprising a cannula suitable for piercing the membrane and comprising a first cannula opening, wherein the cannula is connectable to the first container via the first cannula opening, such that the product fluid can be transferred through the cannula and the first cannula opening out of the first container, and a second cannula opening which, during transfer, forms a fluid connection from the second container to a pressure equalization environment, and a container holder which holds the first container and the second container with the container openings facing each other, and shiftably guides at least one of the containers toward the other container, such that when the at least one of the first and second containers are shifted, the cannula pierces through the membrane of the second container.

2. The transferring device as set forth in claim 1, wherein the transferring device comprises a holding sleeve for the second container, the holding sleeve connected to a protruding part which projects into the holding sleeve.

3. A transferring device or transferring a fluid from a first container which contains the fluid and comprises a container opening into another container comprising a second container opening which is sealed with a membrane which can be pierced through, the transferring device comprising:

a connection cannula which is suitable for piercing through the membrane and which is connected to the first container, such that the fluid can be delivered into and out of the first container through the container opening and the connection cannula;

a container holder which holds the first and second containers with the container openings facing each other and shiftably guides at least one of the containers in a direction toward the other of the containers such that when the containers are shifted toward each other, the connection cannula pierces through the membrane of the second container;

wherein a compensation cannula is held by the container holder in a position between the containers such that the compensation cannula pierces through the membrane of the second container when the containers are shifted towards each other; and wherein the compensation cannula comprises a front cannula opening which is situated in the second container once the membrane has been pierced, and a rear cannula opening which is situated outside the second container once the membrane has been pierced.

4. A method for transferring an injectable product between a first container comprising a first container opening and a second container comprising a second container opening which is sealed by a membrane which can be pierced through, comprising the steps of:

establishing a fluid connection between the first container and the second container by moving at least one of the containers relative to the other whereby a cannula connected to the first container via the first container opening pierces the membrane;

delivering the injectable product by delivering means through the cannula from one of the containers to the other container;

establishing a fluid connection through the membrane between the second container and pressure equalization means, and thereby adjusting a pressure in the other container to an ambient pressure during transfer.

5. The method as set forth in claim 4, wherein the fluid connection between the containers and the fluid connection to the pressure equalization means are established by the cannula piercing through the membrane.

6. The transferring device as set forth in claim 1, further comprising means for determining a depth of penetration of the cannula into the membrane.

7. The transferring device as set forth in claim 6, wherein the determining means includes a cam member and a protrusion member disposed on the container holder, wherein when the first and second containers move towards each other, the cam member is pushed over the protrusion member, and the depth of penetration of the cannula into the membrane is determined by a relative position of the cam member and the protrusion member.

8. The transferring device as set forth in claim 7, wherein the container holder comprises first and second holding sleeves, the cam member is disposed on the first holding sleeve, and the protrusion member is disposed on the second holding sleeve.

9. The transferring device as set forth in claim 3, further comprising means for determining a depth of penetration of the connection cannula into the membrane.

10. The transferring device as set forth in claim 9, wherein the determining means includes a cam member and a protrusion member disposed on the container holder, wherein when the first and second containers move towards each other, the cam member is pushed over the protrusion member, and the depth of penetration of the connection cannula into the membrane is determined by a relative position of the cam member and the protrusion member.

11. The transferring device as set forth in claim 10, wherein the container holder comprises first and second holding sleeves, the cam member is disposed on the first holding sleeve, and the protrusion member is disposed on the second holding sleeve.

12. A transferring device for transferring a product fluid from a first container having a container opening through which the product fluid can be moved into a second container, said transferring device comprising:

delivering means for moving the product fluid into and out of the first container;

a single lumen cannula which is suitable for piercing through a membrane and comprises a front, first cannula opening wherein the cannula is connectable to the first container via a rear, first cannula opening, such that the product fluid can be delivered through the cannula and the cannula openings into and out of the first container; and wherein the cannula further comprises a lateral cannula opening, which, during transfer, forms a fluid connection from the second container to a pressure equilization environment, wherein the lateral opening is gas permeable and liquid tight.

13. The transferring device of 12, wherein the second container comprises a container opening sealed by a membrane that can be pierced through, and the transferring device comprises a container holder which holds the first container and the second container with the container openings facing each other, and shiftably guides at least one of the containers toward the other, such that when the at least one container is shifted, the cannula pierces the membrane.

14. The transferring device of claim 13, wherein the transferring device comprises a holding sleeve for the second container, the holding sleeve connected to a protruding part which projects into the holding sleeve.

15. The transferring device of claim 13, further comprising means for determining a depth of penetration of the cannula into the membrane.

16. The transferring device of claim 15, wherein the means for determining includes a cam member and a protrusion member disposed on the container holder, wherein when the at least one container moves, the cam member is pushed over the protrusion member, and the depth of penetration of the cannula into the membrane is determined by a relative position of the cam member and the protrusion member.

17. The transferring device of claim 16, wherein the container holder comprises first and second holding sleeves, the cam member disposed on the first holding sleeve, and the protrusion member disposed on the second holding sleeve.

18. A method for transferring an injectable product between a first container comprising a first container opening and a second container comprising a second container opening which is sealed by a membrane which can be pierced through, comprising the steps of:

establishing a fluid connection between the first container and the second container by moving at least one of the containers relative to the other whereby a cannula operably coupled to the first container via the first container opening pierces the membrane;

delivering the injectable product by delivering means through the cannula from the first container to the second container;

establishing a fluid connection through the membrane between the second container and a pressure equalization means via a gas permeable liquid tight lateral opening in the cannula, and thereby adjusting a pressure in the second container toward an ambient pressure during transfer.

19. The method of claim 18, wherein the second container comprises a container opening sealed by a membrane that can be pierced through, further comprising the steps of providing a container holder which holds the first container and the second container with the container openings facing each other, and shiftably guiding at least one of the containers toward the other using the container holder, such that when the at least one container is shifted, the cannula pierces the membrane.

20. The method of claim 19, further comprising the step of determining a depth of penetration of the cannula into the second container.

21. The method according to claim the container holder comprising a cam member and a protrusion member disposed on the container holder, wherein the depth of penetration is determined by a relative position of the cam member and the protrusion member.

* * * * *

UNITED STATES PATENT AND TRADEMARK OFFICE

CERTIFICATE OF CORRECTION

PATENT NO. : 6,637,470 B2
DATED : October 28, 2003
INVENTOR(S) : Bruno Reihl et al.

It is certified that error appears in the above-identified patent and that said Letters Patent is hereby corrected as shown below:

Column 14,
Line 50, "The method according to claim the container holder" should read -- The method according to claim 20, the container holder -- therefor.

Signed and Sealed this

Ninth Day of March, 2004

JON W. DUDAS
*Acting Director of the United States Patent and Trademark Office*